United States Patent [19]

Berger et al.

[11] 4,337,896

[45] Jul. 6, 1982

[54] ULTRASONIC FUEL ATOMIZER

[75] Inventors: Harvey L. Berger, Poughkeepsie; Charles R. Brandow, Highland, both of N.Y.

[73] Assignee: Sono-Tek Corporation, Poughkeepsie, N.Y.

[21] Appl. No.: 217,397

[22] Filed: Dec. 17, 1980

Related U.S. Application Data

[63] Continuation of Ser. No. 46,641, Jun. 8, 1979, abandoned.

[51] Int. Cl.[3] ..... H04F 17/00

[52] U.S. Cl. ..... 239/102

[58] Field of Search ..... 239/4, 102, 601

[56] References Cited

U.S. PATENT DOCUMENTS

| | | | |
|---|---|---|---|
| 3,325,858 | 6/1967 | Ogden et al. | 239/102 |
| 3,503,804 | 3/1970 | Schneider | 239/4 |
| 3,904,347 | 9/1975 | Rokoto et al. | 239/102 |
| 4,003,518 | 1/1977 | Hori et al. | 239/4 |
| 4,153,201 | 5/1979 | Berger et al. | 239/4 |

*Primary Examiner*—Robert B. Reeves
*Assistant Examiner*—Gene A. Church
*Attorney, Agent, or Firm*—Kenyon & Kenyon

[57] ABSTRACT

An ultrasonic atomizer having a stepped amplifying section with a flanged atomizing tip. The face of the flange is frusto-conical for providing a cone-shaped spray pattern. The lengths of the amplifying section and flange tip portions are interrelated to provide optimum results.

5 Claims, 3 Drawing Figures

ULTRASONIC FUEL ATOMIZER

Figure 1:
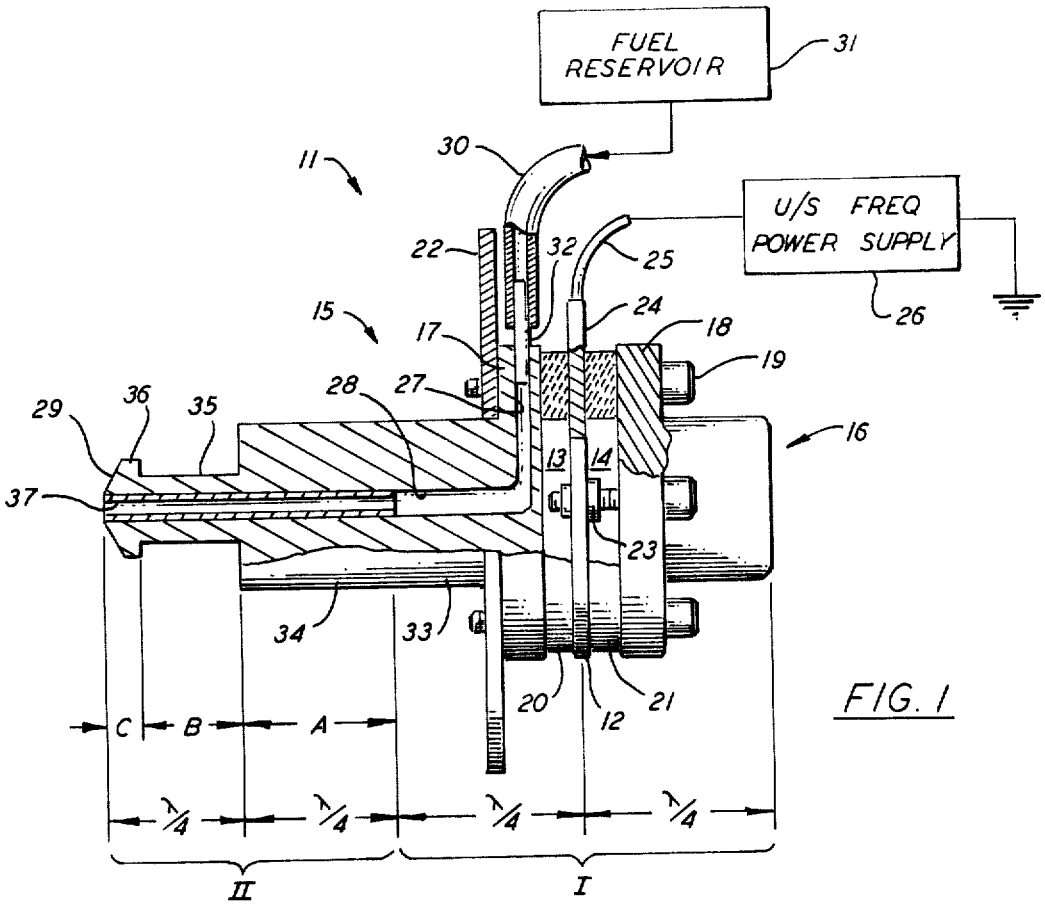

This is a continuation of application Ser. No. 046,641 filed June 8, 1979, and now abandoned.

This invention relates to ultrasonic transducer assemblies, particularly to ultrasonic fuel atomizers, and it is an improvement in atomizers of the type disclosed in our U.S. Pat. No. 4,153,201 issued on May 8, 1979, the disclosure of which is incorporated herein by reference.

As pointed out in the patent, atomizing effectiveness of a probe-type electromechanical ultrasonic transducer can be improved by providing an enlarged diameter tip on the probe in the form of a rigid flange, and the spray pattern and spray density can be influenced by the geometrical contour of the flanged atomizing surface. For example, a planar face perpendicular to the probe axis will develop a particular pattern and density. If the surface is a convex curve, the spray pattern is wider, and there are fewer atomized particles per unit of cross-sectional area than with a planar surface. A concave surface narrows the spray pattern, and the density of particles is greater than with a planar surface.

In applications where an ultrasonic transducer of this type is used as an atomizer in a fuel burner, it is often desirable to produce a wide-angle cone-shaped spray, typically having an apex angle of about 60 degrees. Atomizers with spherically convex atomizing surfaces have proven to be not completely satisfactory for producing such a spray pattern, however. Test results have yielded a spray angle of only about half the predicted angle. Furthermore, a rigid flange transducer tip with a spherically convex atomizing surface has proven to be very difficult to drive, requiring large "gulps" of power to atomize the fuel. Such unstable operation is not acceptable for fuel atomizers used in residential or industrial oil burners.

On the other hand, transducers having rigid flange tips with planar atomizing surfaces have operated stably and efficiently, but the spray pattern generated by the planar atomizing surface is not wide enough to provide proper mixing with incoming air and a good flame in conventional high pressure nozzle types of fuel burners.

It is the principal object of the present invention, therefore, to provide an ultrasonic atomizer having an atomizing surface capable of producing a stable semi-solid cone-shaped spray pattern having a predetermined cone angle and a uniform dispersion of atomized particles from substantially the entire atomizing surface.

This and other objects are achieved by an ultrasonic atomizer which includes a driver, an ultrasonic horn section coupled to the driver and having an amplifying probe with an atomizing surface at the outer end of the probe, and means for delivering a flow of liquid to the atomizing surface, wherein the improvement comprises said atomizing surface having a conical shape, the apex angle of which is equal to the supplement of a preselected spray angle for the atomizer.

Preferably, the conical atomizing surface forms the face of a rigid flange having a base diameter greater than the diameter of the probe, and the liquid to be atomized is supplied through a passage extending axially through the probe and intersecting a radial supply passage located at approximately a nodal vibration plane of the transducer. The combined length of the reduced diameter probe and the flanged tip sections should be less than a theoretical quarter wavelength in the material of the transducer for its operating frequency, and the relative lengths of the probe and the tip should be determined based on their respective diameters so as to maximize the amplitude of vibration at the atomizing surface. For optimized probe and tip lengths, as determined by solution of the basic wave equation, vibration amplitudes for a flanged conical tip can be achieved which are equal to about 97 percent of the maximum amplitude obtainable with a simple cylindrical probe, thereby providing substantially increased atomizing surface area with only insignificantly diminished vibration amplitude.

Figure 2:
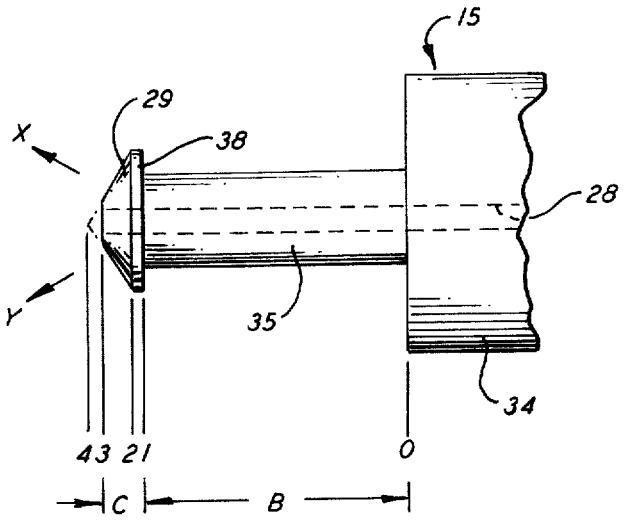
Figure 3:
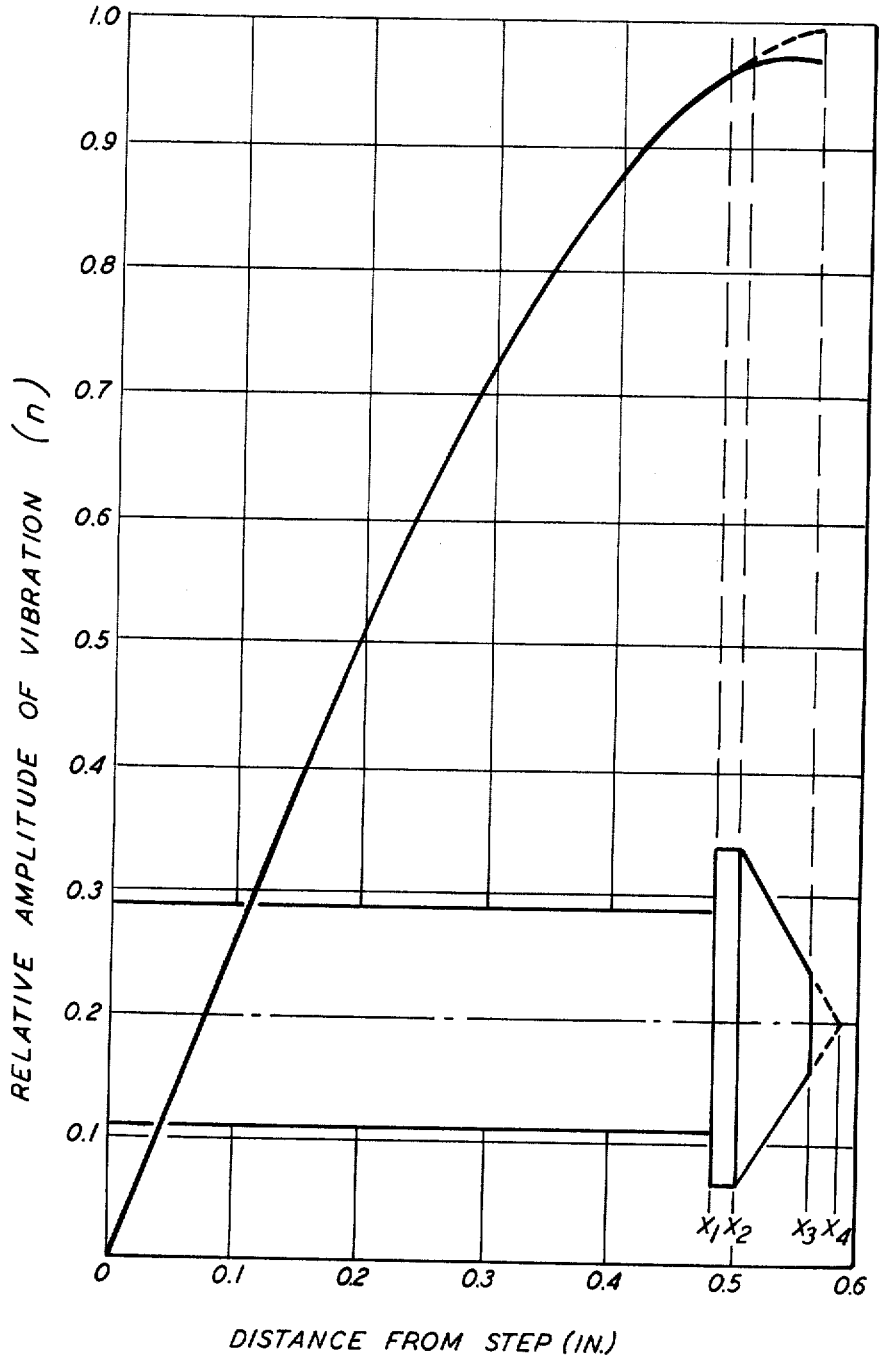

The foregoing and other features and advantages of the present invention will become apparent from the following description of the preferred embodiment in connection with the accompanying drawings, in which:

FIG. 1 is a side view, partially in section, of an atomizing transducer according to the invention, FIG. 2 is a side view in enlarged detail of the probe section with a flanged tip as shown in FIG. 1, and FIG. 3 is a graph of longitudinal vibration amplitude versus distance along the amplifying probe of the present invention.

With reference to FIG. 1, an ultrasonic electromechanical transducer 11 is assembled from an electrode disc 12 sandwiched between a pair of piezoelectric discs 13 and 14 which, in turn, are sandwiched between a front atomizing section 15 and a rear dummy section 16. The front and rear sections are provided with integral bolting flanges 17 and 18, respectively, and the assembly is fastened together with cap screws or allen-head screws 19 which are inserted through aligned holes in bolting flanges 17 and 18, in annular seal rings 20 and 21, and in electrode disc 12 before being screwed into threaded holes in a mounting plate 22.

To prevent shorting the assembly, the screws 19 are surrounded by flanged insulating sleeves 23 where they pass through the holes in the electrode disc. A terminal 24 at the top of the electrode disc permits attachment of a cable 25 from an ultrasonic frequency power supply 26 of conventional design. Since mounting plate 22 is typically part of or attached to an electrically grounded apparatus such as a fuel burner, the metal parts of the assembly other than the electrode disc are grounded, thereby providing a return path through the ground connection of the power supply. Thus an alternating voltage of a predetermined ultrasonic frequency will be developed across the two piezoelectric elements between the electrode disc and the front and rear transducer sections.

The front atomizing section 15 of the transducer includes a radial inlet passageway 27 in flange 17 intersecting an axial delivery passage 28, which extends forward through the front section to an opening at the center of an atomizing surface 29. A supply tube 30 leading from a liquid supply means such as a fuel reservoir 31 may be connected to the radial inlet passageway by a short tube 32 fitted into the entrance of passageway 27, or by any other conventional coupling means.

In functional terms, transducer 11 comprises a symmetrical double-dummy ultrasonic driver I and a vibration amplifier II. The driver includes the electrode disc 12, the two piezoelectric elements 13 and 14, rear dummy section 16, and a portion 33 of front atomizing section 15 which has dimensions identical to those of rear dummy section 16. Thus, portion 33 of front atomizing section 15 forms a front dummy section to substantially match the rear dummy section.

The remainder of front atomizing section 15 forms the vibration amplifier II, which includes a first cylindrical portion 34 of the same diameter as portion 33 and having a length A, a second cylindrical portion 35 in the form of a probe of substantially smaller diameter than that of portion 34 and having a length B, and a third portion 36 in the form of a flanged tip with a diameter larger than that of the probe but considerably smaller than that of portion 34 and having a length C. Preferably, the interior of delivery passage 28 is lined, at least in the exit portion corresponding to amplifier section II, with a decoupling sleeve 37 made of a material having a strong damping characteristic at ultrasonic frequencies. Polytetrafluoroethylene is preferred because it also is unaffected by hydrocarbon fuels, as well as most other liquids of interest for atomization.

Although the vibration amplifier II is an integral part of the front atomizing section, for best performance it is desirable to design the transducer assembly in two stages. In the first stage, a trial transducer is assembled which is identical to driver portion I of the final transducer assembly, that is, a longitudinally symmetrical double-dummy transducer.

The length of this trial transducer assembly is calculated to be equal to one-half of a wavelength λ at a tentatively selected operating frequency f from the relation:

$$\lambda = c/f,$$

where c is the speed of sound in the material chosen for the front and rear sections. Such material should have good acoustic conducting qualities. Aluminum, titanium, magnesium, and their alloys, such as Ti-6Al-4V titanium-aluminum alloy, 6061-T6 aluminum alloy, 7025 high strength aluminum alloy, and AZ61 magnesium alloy, are examples of suitable materials, but others can be used.

The trial transducer assembly is then tested to determine its actual resonant frequency. Since the calculated length is based on pure longitudinal vibration in a homogeneous constant diameter cylinder made of the front and rear transducer section material, it neglects the effects of the flanges, support plate, mounting screws, different materials of the electrode disc and piezoelectric elements, sealing rings, imperfect mating surfaces between elements, non-nodal mounting location, the fuel line coupling and passages, and other departures from the theoretical model. These effects are difficult and in most cases impossible to assess analytically, but cumulatively they shift the actual resonant frequency of the double-dummy transducer by a substantial amount from its theoretical resonant frequency. By using the experimentally determined resonant frequency as the operating frequency of the atomizer, a balanced driver portion is obtained which operates at optimum efficiency.

If the additional effort is justified by the intended application, a closer prediction of the actual resonant frequency of the double-dummy driver can be obtained by considering that each quarter wavelength front and rear section is composed of three cylindrical elements of different diameter, density, and speed of sound, corresponding to the piezoelectric element, the flange, and the smaller diameter portion, respectively. With given piezoelectric element and flange dimensions, the length of the smaller diameter portion can be obtained by solving the well-known differential wave equation for the condition in which the electrode end of the section is at a nodal plane (zero displacement) and the other end of the dummy portion is at an antinode (zero stress).

In the second stage of designing the transducer, a new front atomizing section is made which incorporates a stepped amplification section having a first cylindrical portion of length A, a second, reduced diameter cylindrical probe portion of length B, and a flanged tip of length C, in which the length A and the length B+C are both calculated to be a quarter wavelength at the empirical operating frequency determined in the first stage. Because the amplifier section is a single homogeneous material and has a simple geometry, the lengths A, B, and C as determined from solving the wave equation will provide a section with a natural frequency very close to the operating frequency used in the calculations. In other words, by separating the transducer conceptually into a balanced driver portion I, the resonant frequency of which can be determined accurately only by experiment, and an amplifier section II, the resonant frequency of which can be accurately predicted by theory without undue difficulty, a complete atomizing transducer can be designed having matched driver and amplifying portions for operating at optimum efficiency.

The foregoing transducer design method is disclosed in our above-referenced U.S. Pat. No. 4,153,201, which also discloses the desirability of using a rigid flange atomizing tip at the end of the amplifying probe and specifies that for best results the combined length of the probe and flanged tip (i.e., B+C) should be less than the length A of the larger diameter portion of the amplifying section. The reason for this is that the rigid flanged tip produces a mass loading on the end of the probe that alters the location of the plane of maximum vibrational amplitude by a significant amount when compared with a plain probe without an enlarged tip.

In our above-mentioned patent, a planar atomizing surface perpendicular to the probe axis was preferred, because all regions of such a surface vibrate with the same amplitude, if the tip is rigid at the operating frequency of the transducer. At the same time, it was suggested that a convexly rounded atomizing surface could be used in cases where wider dispersion of the atomized particles was desired. As reported above, however, subsequent tests of such convex atomizing surfaces turned out to be less than satisfactory.

Close observation of the convex atomizing surface under operating conditions revealed that fluid atomization was restricted to an annular region immediately adjacent to the outlet of the liquid delivery passage, where the atomizing surface was substantially perpendicular to the probe axis. In the radially outward regions where the convex atomizing surface made a progressively larger angle with such a perpendicular plane, there were very small amounts of liquid being atomized. From these results it would appear that an angled surface would be ineffective for atomizing a liquid into a wide angle spray.

Surprisingly, however, a conical or frusto-conical atomizing surface according to the present invention has been found to produce excellent results in tests. Test observations indicate that liquid is atomized from the entire conical surface and that the direction of atomization is approximately perpendicular to the conical surface. Consequently, any desired spray apex angle can be obtained merely by selecting a conical atomizing surface having a supplementary apex angle. For example, a conical atomizing surface with an apex angle of 120° will produce a substantially conical spray pattern having an apex angle of 60°.

With reference to FIG. 2, a side view of the outer end of the amplifying portion of the transducer of FIG. 1 shows a frusto-conical flanged atomizing tip according to the present invention in enlarged detail.

As in the case with a planar atomizing surface, a flanged tip gives improved results because of the increased atomizing area. It is equally as important that the flange be rigid. Thus, the outer edge of frusto-conical surface 29 should be supported by a short cylindrical base portion 38. The length of this base portion should be only enough to provide the necessary rigidity to assure that the atomizing surface will vibrate uniformly and not flex at the operating frequency of the transducer, since it is desirable to keep the mass of the flanged tip at a minimum for a given diameter and cone angle.

Since the overall length of the probe and tip has a critical effect on vibration amplitude of the atomizing surface, it is highly important that the lengths B of the probe 35 and C of the tip 36 be determined as accurately as possible. In the case of a flanged tip probe with a planar surface the boundary conditions of the differential wave equation are simple, and so an analytical solution is relatively easy to obtain. For a flanged tip probe with a cylindrical flanged tip having a planar atomizing surface the following relation between lengths B and C has been determined analytically:

$$(\tan kB)(\tan kC) = S_1/S_2,$$

where $k = 2\pi f/c$ $S_1$ = cross-sectional area of probe $S_2$ = cross-sectional area of flange The analytical solution for a conical tip is considerably more complex than for a cylindrical tip because the tip diameter is not constant over its length. An attempt to design an operable conical tip atomizer by using the cylindrical tip equation and assuming the conical tip to be replaced conceptually by an "equivalent" cylinder was not successful, however.

The rationale for this approach was that the relative masses of the probe and tip are the most significant factors affecting their respective longitudinal dimensions. Consequently, a conical tip having the same mass as an "equivalent" cylindrical tip should have equivalent vibrational amplitude. Nevertheless, a conical tip atomizer having its dimensions based on this simplifying assumption failed to produce a satisfactory spray. This result, when considered with the equally unsatisfactory result of the previously-mentioned test of a transducer with a spherically convex tip suggests that an angled surface may not produce satisfactory atomization.

Surprisingly, however, good atomization has been achieved with an atomizer having a conical tip with dimensions established precisely by a rigorous analytical solution. This demonstrates clearly the critical effect that even slight dimensional changes can have on atomizer performance in the case of a conical atomizing surface.

The analytical technique used for establishing the appropriate dimensions of the three constituent parts of a quarter-wavelength amplifying probe section having a flanged tip with a frusto-conical atomizing surface will now be described.

With reference to FIG. 3, the reduced diameter probe and frusto-conical tip portions of the amplifying section of FIG. 2 are reproduced approximately to scale on a plot of normalized vibration amplitude versus axial distance. The coordinate x designates position in the axial direction, and r designates position in the radial direction. The interfaces between the three constituent parts of the probe are labelled $x_1$, $x_2$, and $x_3$; the stepped junction of the reduced diameter probe with the rest of the transducer is at O; and the projected apex of the frusto-conical tip is at $x_4$.

The time-independent equation for the propagation of longitudinal waves in a solid medium at a single frequency f is $$\frac{d}{dx}\left(A(x)\frac{d\eta_i}{dx}\right) + k^2A(x)\eta_i = 0 \tag{1}$$

where $\eta n_i$ is the displacement from equilibrium (equivalent to the amplitude of the oscillation) in the i th region (i=0, 1, 2) as a function of position x; $A_i(x)$ is the cross-sectional area in each region, again as a function of x; and k is the wave number, which is related to the frequency of the wave f and the propagational velocity c of sound in the medium by $k = 2\pi f/c$.

Equation 1 is valid under the conditions of (a) the presence of a single frequency waveform of sinusoidal character;

(b) transverse dimensions less than a quarter-wavelength for the frequency selected; and (c) elastic linearity. These conditions are met in the present case.

For each of the three regions, the cross-sectional area $A_i(x)$ is $$A_0(x) = \pi r_0^2 \qquad 0 \leqq x \leqq x \tag{2a}$$

$$A_1(x) = \pi r_1^2 \qquad x_1 \leqq x \leqq x_2 \tag{2b}$$

$$A_2(x) = \frac{\pi r_1^2 (x_4 - x)}{(x_4 - x_2)^2} \qquad x_2 \leqq x \leqq x_3 \tag{2c}$$

The wave equations associated with the three regions are given by $$\frac{d^2\eta_o}{dx^2} + k^2\eta_o = 0 \qquad 0 \leqq x \leqq x_1 \tag{3a}$$

$$\frac{d^2\eta_1}{dx^2} + k^2\eta_o = 0 \qquad x_1 \leqq x \leqq x_2 \tag{3b}$$

$$\frac{d^2\eta_2}{du^2} + \frac{2}{u}\frac{d\eta_2}{du} + \eta_2 = 0; \qquad x_2 \leqq x \leqq x_3 \tag{3c}$$

$$|u \equiv k(x - x_4)|$$

In regions 0 and 1, where the cross-sectional areas are not functions of x, the area term can be cancelled from the wave equation. In region 2 the area is a variable, and hence the wave equation assumes a much different form. Although the cone angle does not explicitly appear in the expression, the selection of the value for $x_4$ establishes this parameter uniquely.

Analytical solutions to all the second order differential equations of Eqs. (3) are possible. Equations (3a) and (3b) both have simple harmonic solutions. Equation (3c)

is a standard from of the zero-order spherical Bessel equation whose two solutions J and Y, known as spherical Bessel functions, are for order zero given by $$J_0 = \frac{\sin u}{u}\ ;\ Y_0 = -\frac{\cos u}{u}$$

The forms of the three solutions are as follows:

$$\eta_0(x) = A_0\cos kx + B_0\sin kx \qquad 0 \leqq x \leqq x \tag{4a}$$

$$\eta_1(x) = A_1\cos kx + B_1\sin kx \qquad x_1 \leqq x \leqq x_2 \tag{4b}$$

$$\eta_2(x) = \frac{A_2\cos k(x - x_4)}{x - x_4} + \frac{B_2\sin k(x - x_4)}{x - x_4} \qquad x_2 \leqq x \leqq x_3 \tag{4c}$$

where the six constants $A_0$, $A_1$, $A_2$, $B_0$, $B_1$ and $B_2$ are as yet unknown, their values depending on the nature of the boundary conditions at the interfaces between regions and at the section ends.

The boundary conditions are simply stated:

(i) at each interface between regions ($x=x_1$, $x_2$) the amplitude of the wave must be continuous across the interface, and the forces associated with the stress generated by the wave motion must also be continuous.

(ii) at $x=0$ the amplitude of vibration must be zero, because this is a nodal plane.

(iii) at the tip extremity ($x=x_3$), the stress must vanish since the plane of $x_3$ is an antinode.

These boundary conditions can be stated in six simple equations:

$$\eta_0(o) = 0 \qquad \text{(Condition ii)} \tag{5a}$$

$$\eta_0(x_1) = \eta_1(x_1) \tag{5b}$$

$$S_0\eta_0'(x_1) = S_1\eta_1'(x_1) \tag{5c}$$

(Condition i)

$$\eta_1(x_2) = \eta_2(x_2) \tag{5d}$$

$$\eta_1'(x_2) = \eta_2'(x_2) \tag{5e}$$

$$\eta_2'(x_3) = 0 \qquad \text{(Condition iii)} \tag{5f}$$

From these six equations and the solutions to the differential equations (Eqs. 3) it is possible to find the six unknown constants (the A's and B's). There is still a degree of arbitrariness in that calculation since it is possible to determine only the ratios of any of these constants to one of them. Thus, it is necessary to arbitrarily fix a value for one of the constants in order to evaluate the rest. This presents no practical difficulty since, in fact, it is only the relative amplitudes that are of interest in any event.

Prior to calculating these constants, it is necessary to specify the values of $x_1$, $x_2$, $x_3$ and $x_4$ (also $S_0$ and $S_1$). However, and this is the principal observation to be made with regard to this analysis, the length coordinates are not independent of each other; rather they are interrelated by the requirement that the total length equals a quarter-wavelength.

Solving the six boundary condition equations (Eqs. 5) by substituting into each of them the appropriate form of the wave solutions (Eqs. 3) results in a $6\times6$ determinant which is set equal to zero. Solving the determinant yields a lengthy algebraic relationship between the four coordinates. The form of this relationship, called the characteristic equation, is as follows:

$$\tan kx_1 = \frac{S_0}{S_1}\left\{\frac{k(af - be)\cos k(x_2 - x_1) - (cf - ed)\sin k(x_2 - x_1)}{k(af - be)\sin k(x_2 - x_1) + (cf - ed)\cos k(x_2 - x_1)}\right\} \tag{6}$$

where $a = \dfrac{-\cos k(x_2 - x_4)}{x_2 - x_4}$ ; $b = \dfrac{-\sin k(x_2 - x_4)}{x_2 - x_4}$ $$c = \frac{k\sin k(x_2 - x_4)}{x_2 - x_4} + \frac{\cos k(x_2 - x_4)}{(x_2 - x_4)^2}$$

$$d = \frac{-k\cos k(x_2 - x_4)}{x_2 - x_4} + \frac{\sin k(x_2 - x_4)}{(x_2 - x_4)^2}$$

where $$e = -(x_3 - x_4)k\sin k(x_3 - x_4) - \cos k(x_3 - x_4)$$

$$f = (x_3 - x_4)k\cos k(x_3 - x_4) - \sin k(x_3 - x_4)$$

By arbitrarily selecting any three of the four coordinates, a unique value of the fourth one can be calculated by solution of the characteristic equation. As will now be seen, it turns out that $x_1$ is the logical coordinate to compute, after assuming values of $x_2-x_1$, $x_3-x_2$, $x_4-x_3$, and the cylinder cross-sectional areas. Note that the actual constituent lengths, $x_2-x_1$ and so on, are specified rather than the coordinates themselves. These quantities are functionally equivalent in the characteristic equation evaluation and lead to considerable simplification.

The following requirements must be considered in selecting suitable values of the above dimensions:

(a) the mass of the flanged tip must be low enough to avoid an excessive load on the entire atomizer, (b) the conical face must be large enough to provide sufficient atomizing area for the intended flow rates, (c) the cone angle must be selected to produce the desired spray angle, (d) there should be a cylindrical portion at the base of the cone sufficiently thick to assure that the entire tip will vibrate as a rigid body, and (e) the tip must necessarily be frusto-conical to provide a small flat face surrounding the central liquid supply hole.

The opposing requirements or rigidity and low mass determine the optimum length of cylindrical base of the cone, $x_2-x_1$. The desired spray angle fixes the cone apex angle, and the size of the liquid delivery hole fixes the diameter at $x_3$. The diameter of $x_2$ is then determined to provide the required atomizing surface area. The apex angle and the diameters at $x_2$ and $x_3$ then fix the distances $x_3-x_2$ and $x_4-x_3$. This leaves the length $x_1$ of reduced diameter section O, as the only unknown dimension. The value of $x_1$ is computed from the above-described characteristic equation, which takes the form $$x_1 = \tan^{-1} g(x_2-x_1;\ x_3-x_2;\ x_4-x_3;\ A_0/A_1;k) \tag{6}$$

where g is an algebraic expression involving trigonometric functions of the parameters.

EXAMPLE

An ultrasonic atomizer was designed for an operating frequency of 85 kHz, with front and rear sections made of aluminum, piezoelectric discs made of lead-zirconium-titanate (PZT), and a hard copper electrode disc. Since the velocity of longitudinal sound waves in aluminum is about $5.13\times10^5$ cm/sec, a quarter wavelength at the operating frequency is approximately 1.51 cm.

To assure that the transducer vibrates essentially only in the longitudinal mode, the lateral dimensions of the elements should be less than a quarter wavelength. Because the amplification factor of the probe is equal to the ratio of the cross-sectional areas of the transducer body and the probe, the probe diameter should be as small as possible so that sufficient vibration amplitude will be achieved to exceed the atomization threshhold of the liquid being atomized. On the other hand, the minimum probe diameter is limited by the need to provide a liquid delivery passage and still have enough strength and stiffness to support a rigid flanged tip having the required atomizing surface area and to avoid vibration in a cantilever or whipping mode.

With these considerations in mind, the following transducer dimensions were selected to give an amplification ratio of about eight:

PZT Crystal—1.27 cm dia.×0.25 cm thick
Transducer body—1.27 cm dia.
Probe—0.46 cm dia.
Flanged tip—0.70 cm base dia.

For the desired spray cone apex angle of 60°, the corresponding apex angle of the conical atomizing surface should be 120°. The length of the cylindrical base of the conical flange ($x_2-x_1$) should be roughly 0.05 cm to assure that the flange will vibrate as a rigid body. Thus, from simple geometry, the total axial length of a conical face for the probe tip ($x_4-x_2$) would be about 0.20 cm. The actual face is frusto-conical, with a face diameter of about 0.21 cm. Thus, $x_4-x_3$ is 0.06 cm. This reduces the axial length of the frusto-conical face ($x_3-x_2$) to approximately 0.14 cm.

Recapitulating, the predetermined values of the parameters in the characteristic equation are

| | | |
|---|---|---|
| $x_2-x_1=$ | 0.020 in. | (0.051 cm) |
| $x_3-x_2=$ | 0.054 in. | (0.137 cm) |
| $x_4-x_3=$ | 0.026 in. | (0.066 cm) |
| $S_0/S_1=$ | 0.428 | |
| $k=$ | 2.670 $in^{-1}$ | (1.050 $cm^{-1}$) |

This results in $x_1=0.484$ in. (1.230 cm)

Tests conducted with an atomizer constructed with the dimensions of the above example produced a spray having reasonable stability, with liquid being atomized from most of the face at an angle of about 30° with respect to the transducer axis (i.e., 60 degree spray cone angle, as indicated by the arrows X, Y in FIG. 2). In addition to producing the desired spray angle, the frusto-conical atomizing surface greatly reduced the degree to which the atomized drops subsequently coalesced, as compared with the spray delivered by a flat atomizing surface, thereby producing a highly uniform droplet distribution. When the test atomizer was installed in a standard oil burner as a replacement for a conventional high pressure spray nozzle, it produced a very good, self-supporting flame having an appearance quite similar to the flame from the original nozzle.

The results obtained with the atomizer designed in accordance with the above rigorous analytical solution were in distinct contrast to the previously-described test results from the atomizer having an amplifying tip designed with the simplifying assumption needed for using the equation for a cylindrical flange tip. This difference in result is startling since the difference in total length of probe plus tip between the approximate and theoretically exact solutions was only about ten percent. This points up the extreme criticality of the longitudinal dimensions of the amplifying portion of the conical tip ultrasonic atomizer of the present invention.

To complete the analysis, it is desirable to compute the coefficients $A_i$ and $B_i$ of the solutions, Eqs. (3). These are not required for obtaining any further dimensional information but are useful in assessing the efficiency of the overall amplification section design. As mentioned earlier, absolute values for these coefficients are obtainable only when one of them is assigned an arbitrary value. This situation is normal in a system of equations such as the present one where the solutions are those corresponding to unforced oscillations; that is, where no external exciting force is applied to the tip section.

It is natural to assign an arbitrary value to one of the coefficients of the solution for region 0 (Eq. 4a) since this region of the amplifier section couples to the double-dummy section of the nozzle. Since $A_0=0$ as a result of boundary condition Eq. 5a, $B_0=1$ was chosen as the arbitrary value. The four remaining coefficients were then computed by substituting Eqs. 4 into the boundary condition relationships, Eq. 5 and solving the resulting simultaneous equations.

For the given system, the results are $A_1=0.150938961$
$B_1=0.956888663$
$A_2=0.000039163$
$B_2=0.364829648$ In FIG. 3 a plot of relative displacement versus position along the amplifier section is shown. The relative amplitude is defined as the ratio of the actual amplitude to the amplitude that would be present at each point were the amplifier section a uniform cylinder of cross-sectional area $\pi r_0^2$ with a length of a quarter-wavelength. Notice that the tip presence results in an amplitude reduction of only about 3%.

We claim:

1. An ultrasonic atomizer for producing a dispersed spray of finely divided liquid particles, the atomizer including a driver means having an output plane for providing longitudinal vibratory displacement at a predetermined ultrasonic operating frequency; a vibration amplifying means in the form of a stepped ultrasonic horn including a first cylindrical portion having an input end coincident with the output plane of the driver means, the length of the first cylindrical portion being equal to a quarter wavelength at said operating frequency, and a second cylindrical probe portion extending from the other end of the first cylindrical portion and having a diameter substantially smaller than the diameter of the first portion; a flanged tip on the outer end of the second cylindrical probe portion, the diameter of said flanged tip being substantially larger than the diameter of the probe portion but less than the diameter of the first cylindrical portion, and the outer face of said flanged tip forming an atomizing surface; and means for delivering a liquid to flow radially outward across said atomizing surface for atomization by the vibrations produced by said driving means, wherein the improvement comprises:

said atomizing surface having a convexly conical shape that extends to the circumference of said flanged tip and produces a substantially conical spray pattern of finely divided droplets from liquid flowing thereover when the atomizer is driven at said operating frequency, the axis of said conical shape being parallel to the direction of longitudinal vibration, and the apex angle of said conical shape being supplementary to the spray cone angle of the atomized liquid;

the flanged tip having a short cylindrical portion contiguous to and having the same diameter as the base of the conical atomizing surface for assuring that the atomizing surface vibrates only in the longitudinal mode; and the dimensions of said stepped ultrasonic horn conforming to dimensions calculated from the solution of the time-independent differential equation for the propagation of longitudinal waves in a solid medium at said predetermined ultrasonic operating frequency.

2. An ultrasonic atomizer according to claim 1 wherein said means for delivering liquid to said atomizing surface comprises a delivery passage extending axially through said probe portion and flanged tip and opening at the center of said atomizing surface.

3. An ultrasonic atomizer according to claim 2 wherein the flanged tip includes a thin annular planar surface surrounding the opening of the delivery passage, such that the atomizing surface comprises a frusto-conical surface.

4. An ultrasonic atomizer according to claim 1 wherein the first portion of the vibration amplifying means has a length A, the probe portion has a length B, and the flanged tip has an axial length C, and the sum of B and C is less than A.

5. An ultrasonic atomizer according to claim 4 wherein the axial lengths of said probe portion and of the cylindrical and frusto-conical portions of said flanged tip are related by the following equation:

$$\tan kx_1 = \frac{S_o}{S_1}\left\{\frac{k(af-be)\cos k(x_2-x_1)-(cf-ed)\sin k(x_2-x_1)}{k(af-be)\sin k(x_2-x_1)+(cf-ed)\cos k(x_2-x_1)}\right\}$$

$$\text{where } a = \frac{-\cos k(x_2-x_4)}{x_2-x_4}\ ;\ b = \frac{-\sin k(x_2-x_4)}{x_2-x_4}$$

$$c = \frac{k\sin k(x_2-x_4)}{x_2-x_4} + \frac{\cos k(x_2-x_4)}{(x_2-x_4)^2}$$

$$d = \frac{-k\cos k(x_2-x_4)}{x_2-x_4} + \frac{\sin k(x_2-x_4)}{(x_2-x_4)^2}$$

$$e = -(x_3-x_4)\,k\sin k(x_3-x_4) - \cos k(x_3-x_4)$$

$$f = (x_3-x_4)\,k\cos k(x_3-x_4) - \sin k(x_3-x_4),$$

$x_1$ is the length of the probe portion, $x_2-x_1$ is the length of the cylindrical portion of the flanged tip, $x_2-x_3$ is the length of the frusto-conical portion of the flanged tip, $x_3-x_4$ is the axial distance from the outer end of the frusto-conical portion to the apex of a cone containing the frusto-conical surface of said tip, $S_0$ is the cross-sectional area of the probe portion, and $S_1$ is the cross-sectional area of the cylindrical portion of the flanged tip.

* * * * *